United States Patent [19]

Choi

[11] Patent Number: 4,610,416

[45] Date of Patent: Sep. 9, 1986

[54] BOOK HOLDER

[76] Inventor: Dai S. Choi, 3101 Palm Ave., Manhattan Beach, Calif. 90266

[21] Appl. No.: 684,796

[22] Filed: Dec. 21, 1984

[51] Int. Cl.[4] ..... A47B 97/08

[52] U.S. Cl. ..... 248/459; 248/464

[58] Field of Search ..... 248/459, 463, 464, 465, 248/455

[56] References Cited

U.S. PATENT DOCUMENTS

| | | | |
|---|---|---|---|
| 1,607,752 | 11/1926 | Higdon | 248/455 X |
| 1,759,519 | 5/1930 | Moore | 248/463 X |
| 2,992,500 | 7/1961 | Hayhow | 248/459 X |
| 3,097,444 | 7/1963 | Steiner | 248/459 X |
| 3,550,895 | 12/1970 | Guiles | 248/459 |
| 4,274,616 | 6/1981 | Radtke | 248/459 |
| 4,330,102 | 5/1982 | Gebhardt et al. | 248/459 |

FOREIGN PATENT DOCUMENTS

| | | | |
|---|---|---|---|
| 67283 | 7/1948 | Denmark | 248/463 |
| 1389072 | 1/1965 | France | 248/455 |

*Primary Examiner*—Ramon S. Britts
*Assistant Examiner*—Karen J. Chotkowski
*Attorney, Agent, or Firm*—Birch, Stewart, Kolasch & Birch

[57] ABSTRACT

A foldable book stand which comprises, a front surface and a rear surface, said front surface having substantially parallel transverse crease lines disposed across the lower portion thereof, said front surface being folded on itself in opposite directions along said crease lines, said rear surface having triangular lateral flanges which are extendable from the rear surface along respective vertical crease lines and a transverse support member extendable from the rear surface along a horizontal crease line, said lateral flanges containing slots and said transverse support member containing end tabs for engaging in said slots, whereby the book stand is readily convertible from a flat folded state to an assembled state.

6 Claims, 9 Drawing Figures

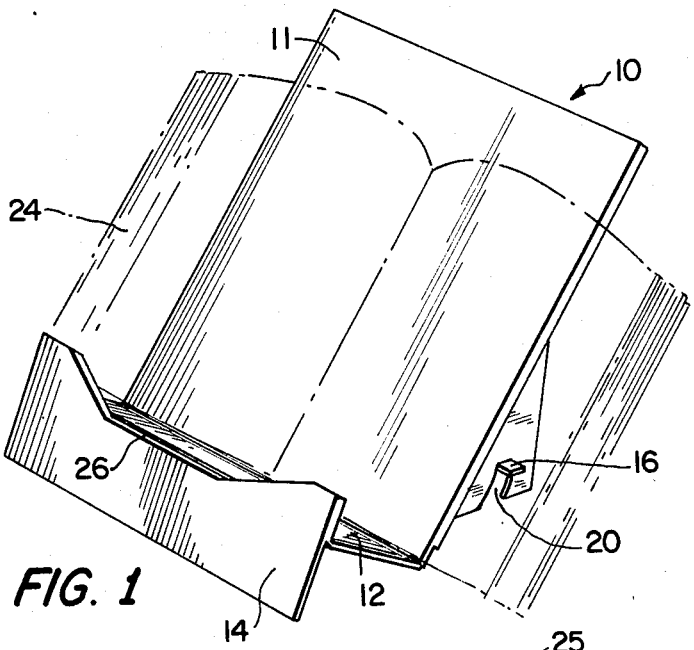
FIG. 1
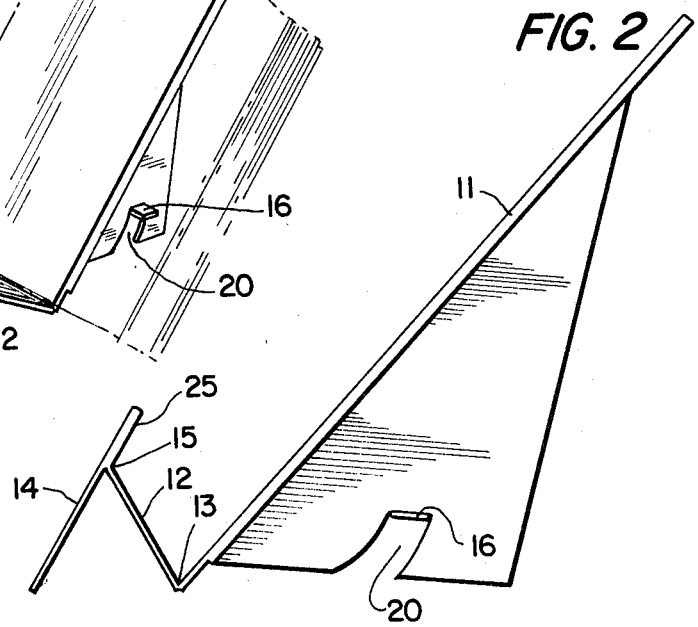
FIG. 2
FIG. 3
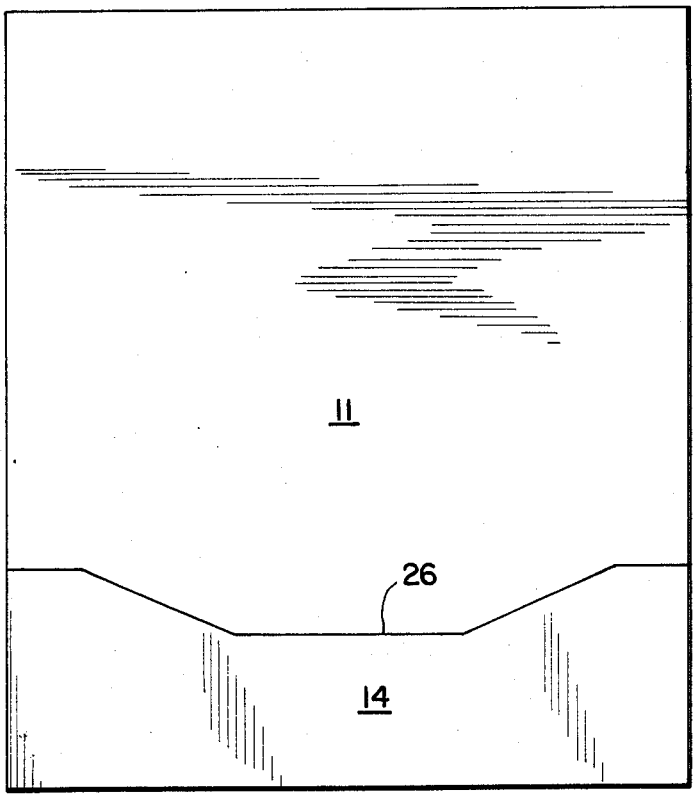
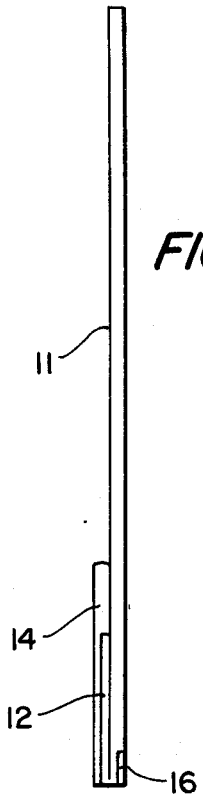
FIG. 4

BOOK HOLDER

BACKGROUND OF THE INVENTION

The present invention relates to a new and unique book holder which can be folded in a flat position for carrying but can be constructed into a book support whereby books, magazines or other printed matter may be easily held for reading. More particularly, the present invention is directed to a single elongated piece of pliable sheet material which contains several crease lines and cut out portions which enables the flat sheet material to be constructed into an upright support for reading material, such as a book, magazine or the like.

SUMMARY AND OBJECTS OF THE INVENTION

Accordingly, it is an object of the present invention to provide a book holder which is structured to be folded as a single flat sheet to facilitate carrying it from place to place.

Another object of the present invention is to provide a foldable book holder which is made of a plastic, hard paper, or cardboard material.

A further object of the present invention is to provide a portable book holder which can be used anywhere such as on a desk, on a bed or for reading in the yard.

Still another object of the present invention is to provide an improved book holder which can be readily assembled to support a book at a proper angle for reading.

Yet another object of the present invention is to provide a foldable book holder to which is attached a light for reading.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention, and wherein:

FIG. 1 is a perspective view of the assembled book holder of the present invention;

FIG. 2 is a side view of the book holder of the present invention;

FIG. 3 is a front view of the book holder of the present invention in a flat, collapsed position;

FIG. 4 is a side view of the book holder of the present invention in a flat folded position;

DETAILED DESCRIPTION OF THE INVENTION

Figure 5:
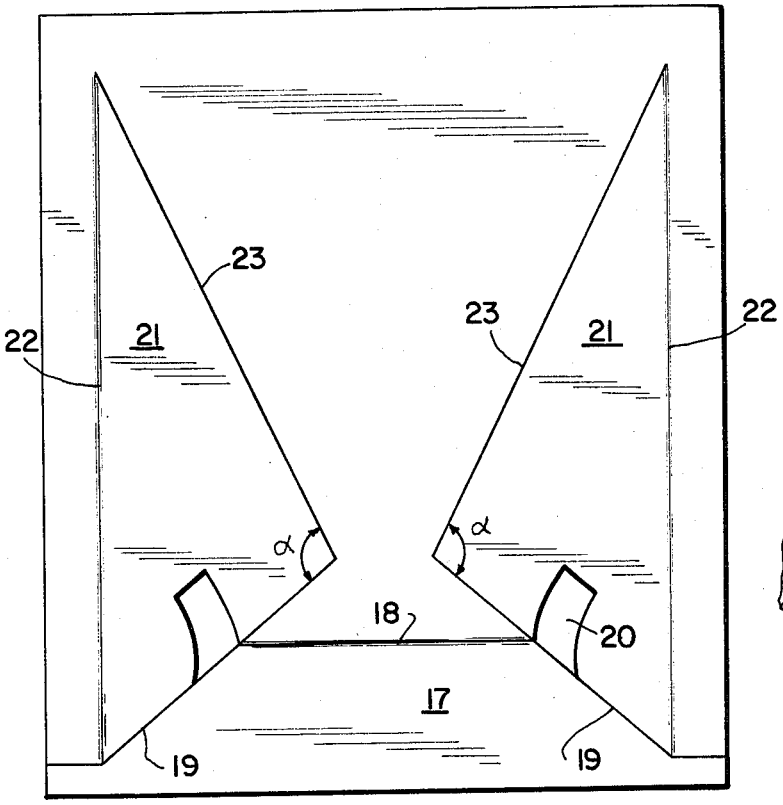
FIG. 5 is a rear view of the book holder of the present invention in an assembled position.

Referring now in detail to the drawings for the purpose of illustrating the present invention, FIG. 1 shows a foldable, pliable book holder 10 made of a vinyl plastic, paper, cardboard, cloth or the like, comprising a main support portion 11 extending into a support portion 12 through a transverse crease line 13. A front stand portion 14 is established by bending the stand along crease line 15.

The main support portion 11 is supported by triangularly shaped lateral support members 21 defined by crease lines 19, 22 and 23. The lateral support members are fixed in position by transverse support member 17 having tabs 16 which fit into slots 20 of the lateral support members when the transverse support member in folded along crease line 18.

When a book 24 is placed on the main support portion 12, the pages of the book are prevented from turning by a lip portion 25 which extends above central portion 26. The central portion 26 is lower than the lip portion 25 to enable the reader to view the pages of the book when it is in reading position on the main support portion of the book stand. The lateral support member 21 can be designed within a wide range of angles $\alpha$ to suit the reader and his reading position. Thus the angle $\alpha$ can vary between about 95° to 135° preferably 110° to 125°, as shown in FIG. 5.

Advantageously, the slots 20 have a curved configuration which greatly facilitate the insertion of the tabs 16 into said slots.

Figure 7:
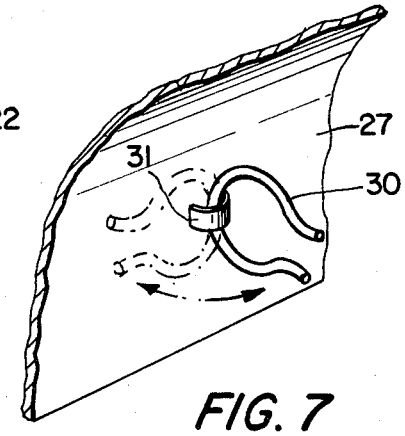
FIG. 7 is a perspective view of the book holder of the present invention containing a holder for a light bulb as shown in FIG. 6.
Figure 6:
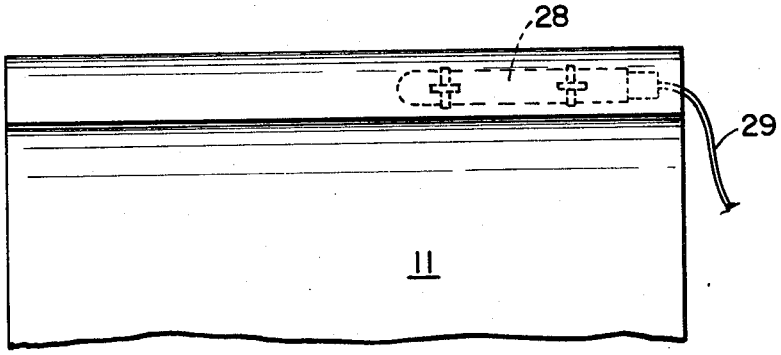
FIG. 6 is a front view of the book holder of the present invention containing provisions for a light bulb.
Figure 8:
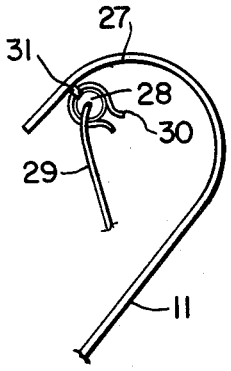
FIG. 8 is a side view of the book holder of FIG. 6 showing one configuration of the light bulb and light bulb holder.
Figure 9:
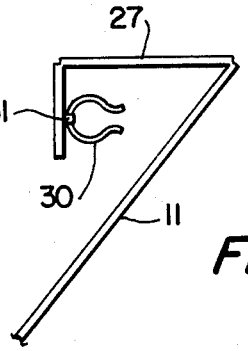
FIG. 9 is a side view of the book holder of FIG. 6 showing another configuration of the light bulb and light bulb holder.

In another embodiment of the present invention, the main support portion 11 is provided with a curved end 27 having a spring clamp 30 fixed to the inside surface thereof by a hook attachment 31. A light 28 containing electrical cord 29 can be readily inserted into the spring clamp 30. FIGS. 6, 7 and 8 show the arrangement of the light in the book holder. When the lamp 28 is not needed, the spring clamp 30 can be folded against the curved end 27 as shown in FIG. 7. FIG. 9 shows another embodiment of a light attachment which, when not in use, can be folded into a flat position.

The folded book holder of the present invention is light in weight, inexpensive and can be readily converted from a flat carrying position to a book supporting position.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A one-piece foldable book stand formed from a single piece of sheet material for use in a substantially flat surface, which comprises, a front surface and a rear surface, said front surface having substantially parallel transverse crease lines disposed across the lower portion thereof, said front surface being folded on itself in opposite directions along said crease lines to form a front stand portion, and a support portion on one end of said front stand portion supporting the front stand portion at an angle above said flat surface and the other end thereof having a raised peripheral lip portion for preventing the pages of a book from turning, said rear surface having triangular lateral flanges which are extendable from the rear surface along respective vertical crease lines and a transverse support member extendable from the rear surface along a horizontal crease line, said lateral flanges containing slots and said transverse support member containing end tabs as an integral part thereof for engaging in said slots, whereby the book stand is readily convertible from a flat folded state to an assembled state.

2. The folded book stand of claim 1 wherein the raised peripheral lip of the front stand portion has a recessed central portion for permitting a clear view of the book pages.

3. The foldable book stand of claim 1 wherein the slots are provided with curved surface to facilitate engagement with the end tabs.

4. The foldable book stand of claim 1 wherein the upper portion thereof is curved and provided with at least one spring clamp for receiving a light.

5. The foldable book stand of claim 4 wherein the spring clamp is foldable against the inside upper curved portion.

6. The foldable book stand of claim 1 wherein the upper portion thereof is folded inward and provided with at least one spring clamp for receiving a light.

* * * * *